United States Patent [19]

Hollyday et al.

[11] Patent Number: 4,643,509

[45] Date of Patent: Feb. 17, 1987

[54] GROUNDING CLIP FOR FILTERED ELECTRICAL CONNECTOR

[75] Inventors: Robert D. Hollyday, Elizabethtown; Patrick F. Yeager, Middletown, both of Pa.

[73] Assignee: AMP Incorporated, Harrisburg, Pa.

[21] Appl. No.: 728,924

[22] Filed: May 3, 1985

Related U.S. Application Data

[63] Continuation-in-part of Ser. No. 621,005, Jun. 15, 1984, abandoned.

[51] Int. Cl.[4] ..... H01R 4/66; H01R 13/66

[52] U.S. Cl. ..... 339/147 R; 339/14 R

[58] Field of Search ..... 339/14 R, 143 R, 147 R, 339/92 M, 176 M, 176 MP; 333/182, 183

[56] References Cited

U.S. PATENT DOCUMENTS

| | | | |
|---|---|---|---|
| 3,538,464 | 11/1970 | Walsh | 333/79 |
| 4,126,840 | 11/1978 | Selvin | 333/79 |
| 4,181,391 | 1/1980 | Kilsdonk | 339/92 M |
| 4,212,510 | 7/1980 | Ritchie et al. | 339/147 R |
| 4,296,390 | 10/1981 | Vanderheyden et al. | 333/182 |
| 4,371,226 | 2/1983 | Brancallone | 339/147 R |
| 4,376,922 | 3/1983 | Muzslay | 333/182 |

*Primary Examiner*—Eugene F. Desmond
*Attorney, Agent, or Firm*—Katherine A. Nelson

[57] ABSTRACT

A grounding clip is provided for grounding a filtered electrical connector having a planar capacitor, upon mounting a forward end of the connector to a ground plane of a panel. The grounding clip is secured to a mounting surface of a mounting flange of the connector and has a spring contact arm extending into a cavity of the connector to both engage a ground electrode of the planar capacitor and secure the grounding clip to the connector. An adaptor clip is also provided to be secured, if desired, to the mounting flange and the grounding clip for providing grounding if it is desired to mount the rearward end of the connector of the panel.

22 Claims, 11 Drawing Figures

56
58
54
50
60
56
54
32

76
64
56
76
78
72
54
78
62
84
80
54
56
70
32
48

GROUNDING CLIP FOR FILTERED ELECTRICAL CONNECTOR

RELATED APPLICATION INFORMATION

This application is a continuation-in-part of U.S. patent application Ser. No. 621,005 filed June 15, 1984, now abandoned.

FIELD OF THE INVENTION

This invention relates to the field of electrical connectors and, more particularly, to filtered connectors.

BACKGROUND OF THE INVENTION

Electrical connectors for the transmission of signals are known which utilize filtered terminals to minimize EMI or electromagnetic interference with signal transmission. U.S. Pat. No. 4,296,390 assigned to the assignee of the present invention, discloses such a connector wherein an array of pin terminals having filter sleeves extend through holes in a metallic ground plane extending axially normally through the connector, the pins secured on both sides of the ground plane by protective hermetically sealing rubber blocks, one of the rubber blocks having a conductive rubber gasket adjacent the ground plane to assure electrical grounding contact of the filter sleeves with the ground plane. A pair of insulative housing members are secured to both sides of the ground plane, such that the ground plane extends outwardly for external grounding. Such filter pins are replaceable.

Another approach to filtered connectors is taught by U.S. Pat. No. 4,376,922, wherein a row or rows of contact terminals without individual filter sleeves have integral spring fingers intermediate the two contact ends of each terminal, which are aligned to electrically engage respective spaced live electrodes of a monolithic capacitor. The monolithic capacitor has ground electrodes formed on the end edges thereof which are in electrical engagement with a pair of ground planes embedded in the capacitor. Insulator housing members have the contact terminals secured in respective cavities and the capacitor secured in a slot. Metal shell members shieldingly surround the sides of the insulator housings and have grounding springs extending into ends of the capacitor slot to electrically engage the ground electrode on the side edges of the capacitor; the metal shell can then be grounded. Such an assembly is said not to require potting or soldering of parts.

SUMMARY OF THE INVENTION

A grounding clip is provided for being assembled in opposing pairs externally to an electrical connector by use of a spring contact arm inserted into a slot in the dielectric connector housing such that the spring contact arm of each clip electrically engages a respective one of ground electrodes on opposing end edges of a planar capacitor contained within the housing in electrically filtering engagement with contact terminals secured therein. The grounding clip is electrically engageable to ground by being assembled to an external surface of the housing, preferably to a forwardly-facing surface of a mounting flange of the connector which is secured against a panel or backplane of equipment.

An adaptor grounding clip is also provided which is optionally assemblable in a selected application to a connector having a grounding clip of the invention previously assembled to a forwardly-facing surface of a mounting flange, such that the adaptor clip is securable to the mounting flange on the rearwardly-facing surface thereof and is in electrical engagement with both the grounding clip and the ground plane of the panel or backplane of the equipment when mounted thereto.

DETAILED DESCRIPTION OF THE PREFERRED EMBODIMENT

Figure 1:
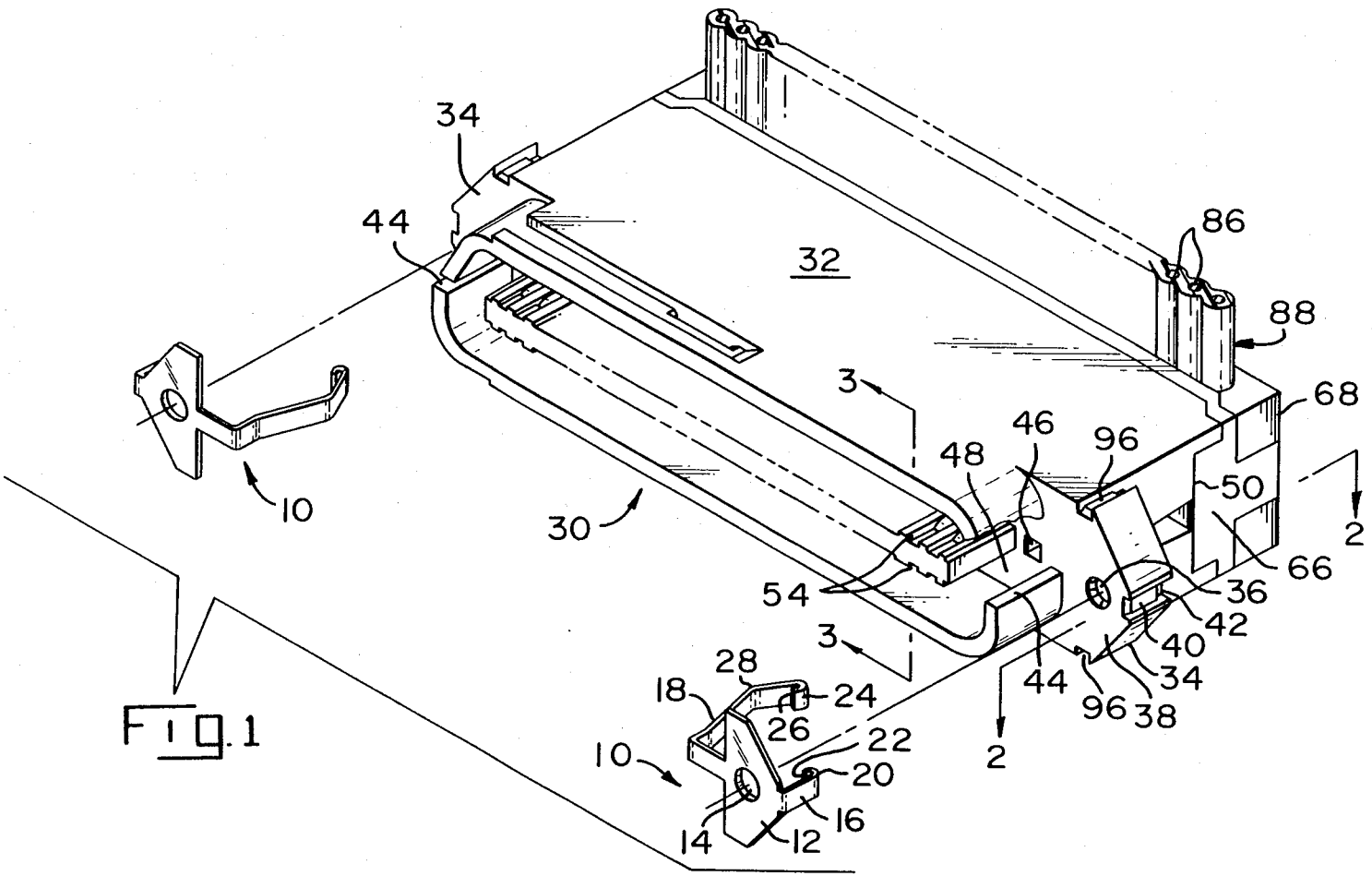
FIG. 1 is a perspective view of a connector assembly with grounding clips exploded therefrom.

FIG. 1 illustrates an electrical connector 30 such as a panel mountable CHAMP/Latch (trademark of AMP incorporated) receptacle connector for ribbon cable having a planar capacitor therein (not shown) and a pair of metal grounding clips 10 of the invention. Each grounding clip 10 has a body section 12 having a hold 14 therethrough for mounting purposes, a short fastening arm 16, and a spring contact arm 18. Connector 30 has a main dielectric housing 32 with an ear-like mounting flange 34 on each side thereof, each having a mounting hole 36 therethrough. A ground clip 10 is securable to forwardly-facing surface 38 of its associated mounting flange 34 such that hole 14 of grounding clip 10 is aligned with hole 36 of mounting flange 34, and the shape of body portion 12 of grounding clip 10 coincides with the shape of surface 38. (Part of a forward wall of main housing 32 is broken away in FIG. 1 at right-hand slot 44 to show a cavity 46 which is explained in more detail herebelow.)

Figure 2:
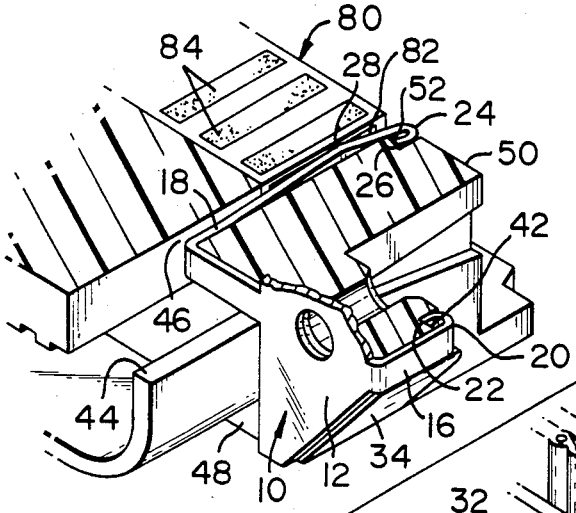
FIG. 2 is an enlarged part cross-sectional perspective view along lines 2—2 of FIG. 1 showing the grounding clip in engagement with the planar capacitor.

As seen in FIG. 2, grounding clip 10 is secured onto mounting flange 34 by means of fastening arm 16 and spring contact arm 18. Fastening arm 16 has a bent back portion 20 at the end thereof forming a stop surface 22; fastening arm 16 is securable within recess 40 of mounting flange 34 which secures fastening arm 16 against lateral movement, and stop surface 22 abuttingly engages recess ledge 42 of recess 40 which secures fastening arm 16 against longitudinal movement.

Spring contact arm 18 of grounding clip 10 is first insertable through an associated housing slot 44 within main housing 32 proximate forward end 48 thereof, one such slot being proximate each side of the housing. A cavity 46 extends longitudinally in communication with forward end 48 of main housing 32 and rearward end 50 of main housing 32. Cavity 46 has a cavity ledge 52 proximate rearward end 50 such that a bent-back portion 24 of spring contact arm 18 forms a stop surface 26 which abuttingly engages cavity ledge 52 to secure spring contact arm 18 against longitudinal movement.

Spring contact arm 18 has a contact section 28 which engages a ground electrode 82 of planar capacitor 80, one of such ground electrodes 82 being situated on each side end of planar capacitor 80. Spring contact arm 18 is shaped such that contact section 28 normally extends inwardly from the side of main housing 32 when grounding clip 10 is assembled thereto, and is loaded in a spring biased condition against ground electrode 82 of planar capacitor 80, and is thereby in electrical contact with ground electrode 82.

Figure 3:
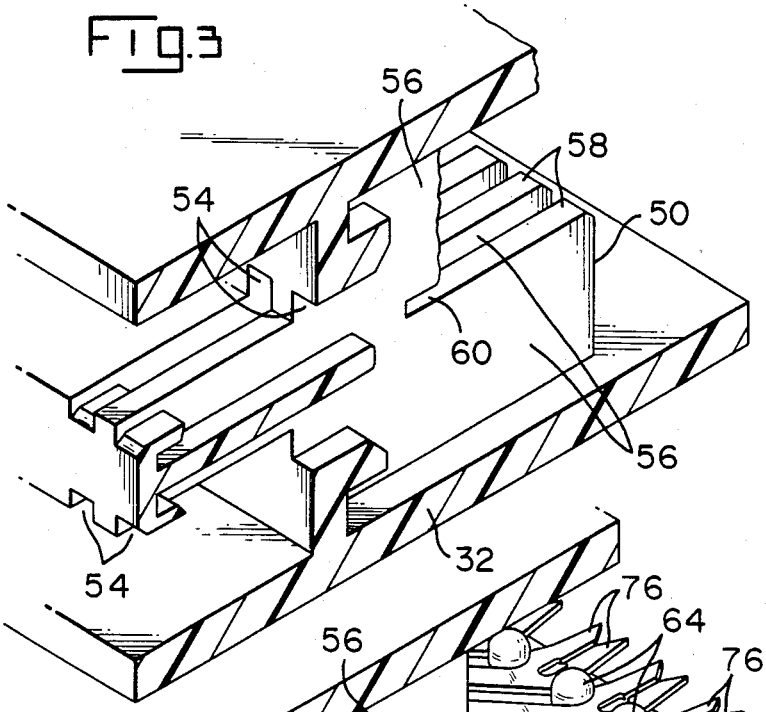
FIG. 3 shows a perspective of the connector in longitudinal section along lines 3—3 of FIG. 1, showing the planar capacitor with terminals removed.
Figure 4:
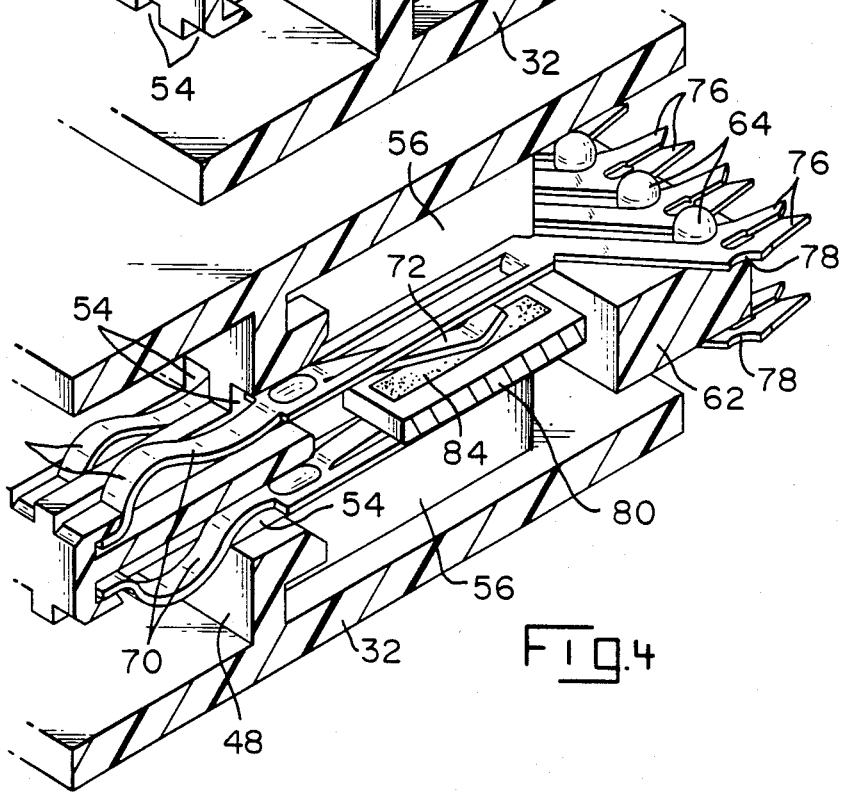
FIG. 4 shows FIG. 3 with terminals and support member in place.

FIGS. 3 and 4 illustrate the inner features of connector 30. FIG. 3 is a longitudinal section of main housing 32 with terminals 70 removed. Between terminal cavities 54 are longitudinally extending ribs 56 directed inwardly from sides of main housing 32 and having centrally facing edges 58 which altogether form a capacitor-holding slot 60. Planar capacitor 80 is positionable between centrally facing edges 58 such that edges 58 of ribs 56 engage planar capacitor 80 between live electrodes 84 thereof.

FIG. 4 shows terminals 70 in position in connector 30. Terminals 70 are secured in terminal cavities 54, have curved contact sections 74 proximate forward end 48 of main housing 32, and have slotted contact sections 76 extending outward from rearward end 50 of main housing 32 to engage conductors 86 of cable 88 (see FIG. 1) by insulation displacement. Intermediate the contact sections 74 and 76 of each terminal 70 is a spring contact section 72 extending toward and in engagement with a live electrode 84 of planar capacitor 80. Once terminals 70 and planar capacitor 80 are in place within main housing 32 a dielectric support member 62 is adheringly secured against rearward end 50 of main housing 32, behind and against planar capacitor 80 and between and against the two rows of terminals 70. Dielectric support member 62 has spaced projections 64 which extend between terminals 70, and engage terminals 70 in notches 78 thereof to space said terminals and secure them against lateral and longitudinal movement.

With reference to FIG. 1, a dielectric securing body portion 66 is then bonded to rearward end 50 of main housing 32 to secure planar capacitor 80 and terminals 70 within connector 30. When conductors 86 of cable 88 are then terminated to slotted contact sections 76 of associated terminals 70, a dielectric cover member 68 is latchingly secured to the outer end of securing body portion 66. Cover member 68 is used to push conductors 86 into the slots of slotted contact sections 76. Grounding clip 10 may then be placed in position as shown in FIGS. 1 and 2, secured to main housing 32 by spring contact arm 18 and fastening arm 16, to complete the connector assembly.

Connector assembly 30 (without reference to a Figure hereof) is mountable to the backplane of a piece of equipment by a mounting means such as a bolt, so that grounding clip 10 is adjacent to and in electrical engagement with a ground plane of the backplane. Also, other means of grounding the connector 30 are possible by connecting grounding clip 10 to ground, since grounding clip 10 is on the outside surface of connector 30.

Figure 5:
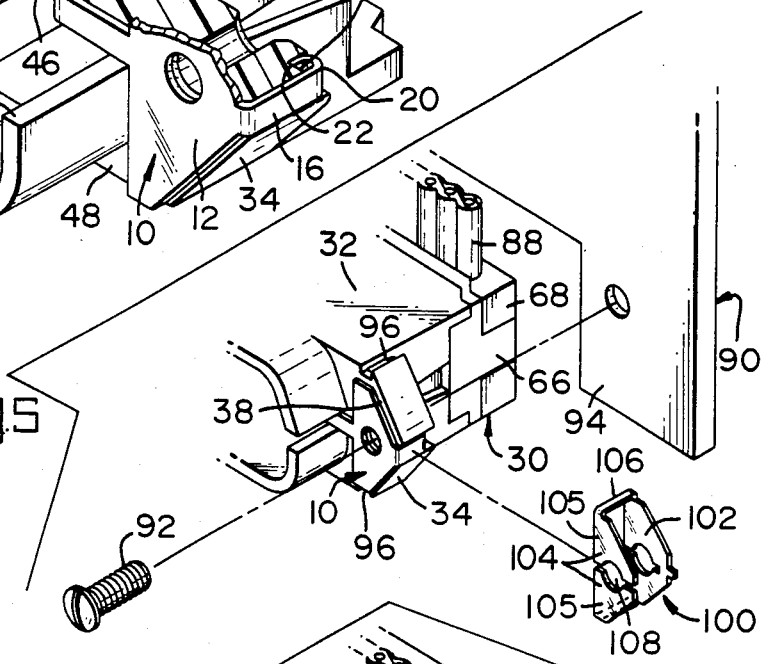
FIG. 5 shows a perspective view a connector with a grounding clip thereon and an adaptor clip exploded therefrom, spaced from a backplane.

FIG. 5 shows a metal adaptor clip 100 securable on both surfaces of mounting flange 34 including the rearwardly-facing surface, grounding clip 10 having already been secured to forwardly-facing surface 38 thereof. Adaptor clip 100 has opposing body portions 102, 104 and a pair of bridge arms 106 interconnecting body portions 102, 104. Each body portion 102, 104 has a hole 108 therethrough such that holes 108 of each adaptor clip 100 are aligned with holes 36 of mounting flanges 34 when adaptor clips 100 are secured thereto. Each adaptor clipp 100 is preferably stamped and formed. When formed, one body portion 104 will be comprised of two halves 105 which will meet or nearly meet each other. Bridge arms 106 extend through associated side recesses 96 on the sides of mounting flange 34 and proximate housing 32 to secure adaptor clip 100 to the connector assembly 30. Adaptor clip 100 is useful for enabling the person mounting the connector assembly 30 to a backplane 90 by using mounting means 92 to mount connector 30 to the opposite side of the backplane (the side proximate mounting flanges 34 being ground plane 94) from the side to which the connector ordinarily would be mounted adjacent forwardly-facing surface 38 of mounting flange 34 on which is secured body portion 12 of grounding clip 10.

Figure 6:
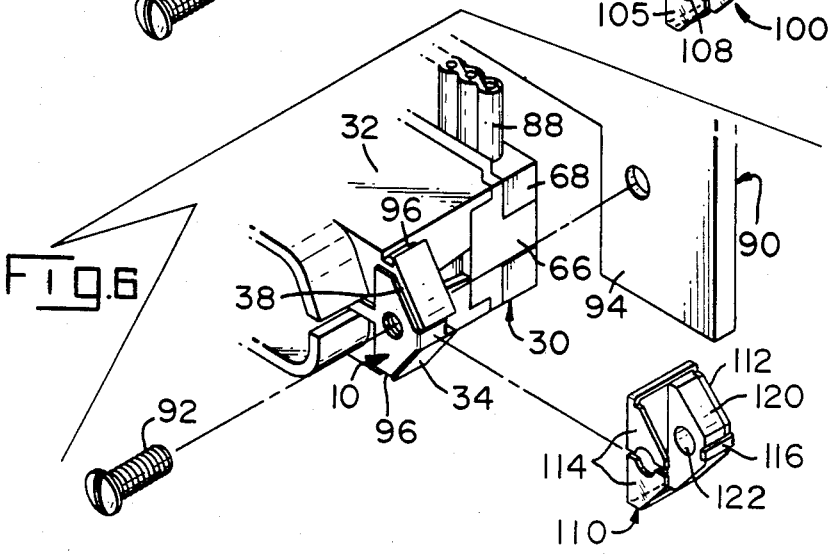
FIG. 6 shows a perspective view of a modified adaptor clip with a spacer, for use with the connector of FIG. 1.

FIG. 6 illustrates a modified adaptor clip 110 which is modified to incorporate a dielectric spacer 120, having a preselected thickness and an outline matching that of mounting flange 34 and a hole 122 therethrough. Modified adaptor clip 110 allows the connector assembly to be mounted onto a backplane 90 (with one body portion 112 of modified adaptor clip 110 in electrical engagement with a ground plane 94 on backplane 90, the other body portion 114 with grounding clip 10) in a manner varying the depth to which connector assembly 30 extends into the backplane 90, and hence the distance which connector 30 extends outwardly from the backplane. Spacer 120 is held by fastening arm 116 and may be adhered to modified adaptor clip 110 within it, secured at the point of manufacture, in order to simplify the mounting procedure.

Figure 7:
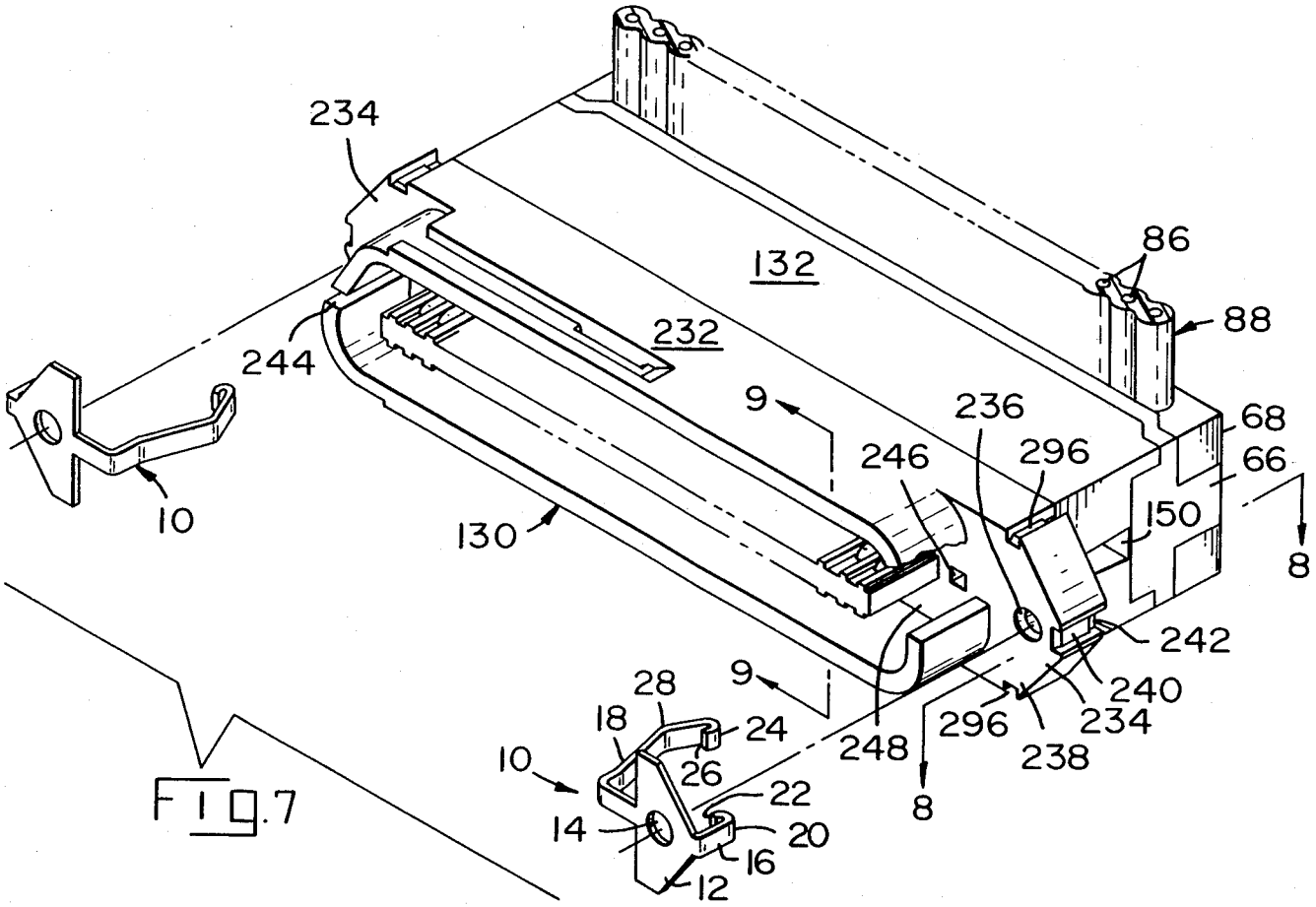
FIG. 7 is a perspective view of an alternative embodiment of the connection assembly of FIG. 1 with grounding clips exploded therefrom.

FIG. 7 illustrates an alternative embodiment 130 electrical connector such as a panel mountable CHAMP-/Latch (trademark of AMP Incorporated) receptacle connector for ribbon cable having a planar capacitor therein (not shown) and a pair of metal grounding clips 10 of the invention. Each grounding clip 10 has a body section 12 having a hole 14 therethrough for mounting purposes, a short fastening arm 16, and a spring contact arm 18. Connector 130 has a main dielectric housing 132 and metal shell member 232 which is dimensioned to engage with and surround a portion of the main dielectric housing 132. The metal shell 232 has an ear-like mounting flange therethrough. A ground clip 10 is securable to forwardly-facing surface 238 of its associated mounting flange 234 such that hole 14 of grounding clip 10 is aligned with hole 236 of mounting flange 234, and the shape of body portion 12 of grounding clip 10 coincides with the shape of surface 238. Part of a forward wall of shall member 232 is broken away in FIG. 7 at right-hand slot 244 to show a cavity 246 which is explained in more detail herebelow.)

Figure 8:
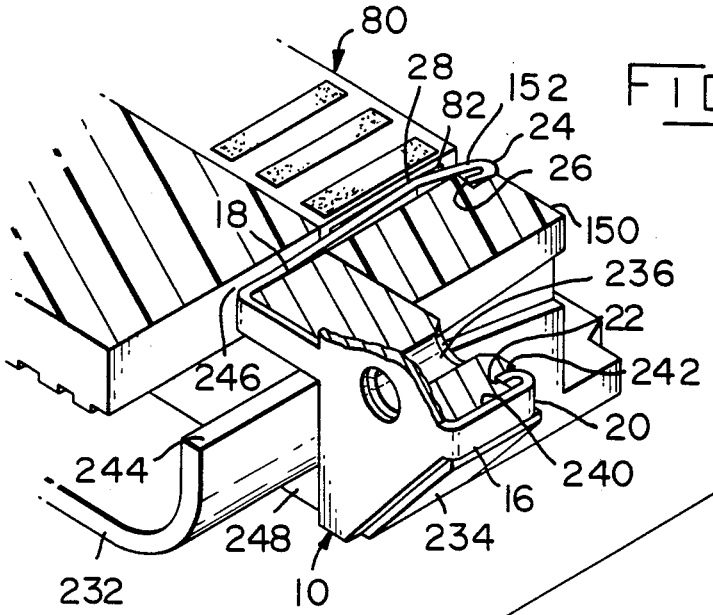
FIG. 8 is an enlarged part cross-sectional perspective view along lines 8—8 of FIG. 7 showing the grounding clip in engagement with the planar capacitor.

As seen in FIG. 8, grounding clip 10 is secured onto mounting flange 234 by means of fastening arm 16 and spring contact arm 18. Fastening arm 16 has a bent back portion 20 at the end thereof forming a stop surface 22; fastening arm 16 is securable within recess 240 (shown in FIG. 7) of mounting flange 234 which secures fastening arm 16 against lateral movement, and stop surface 22 abuttingly engages recess ledge 242 of recess 240 which acts as a cooperating stop surface and also secures fastening arm 16 against longitudinal movement.

Spring contact arm 18 of grounding clip 10 is first insertable through an associated shell member slot 244 within shell member 232 proximate forward end 248 thereof, and into the main dielectric housing 132. One such slot being proximate each side of the shell and main housing members. A cavity 246 in housing 132 extends longitudinally in communication with forward end 248 of the shell member and rearward end 150 of main dielectric housing 132. Cavity 246 has a cavity ledge 152 proximate rearward end 150 such that a bent-back portion 24 of spring contact arm 18 forms a stop surface 126 which abuttingly engages cavity ledge 152 acting as a cooperating stop surface and securing spring contact arm 18 against longitudinal movement.

Spring contact arm 18 has a contact section 28 which engages a ground electrode 82 of planar capacitor 80, one of such ground electrodes 82 being situated on each end surface of planar capacitor 80. Spring contact arm 18 is shaped such that contact section 28 normally extends inwardly from the side of main dielectric housing 132 when grounding clip 10 is assembled thereto, and is loaded in a spring biased condition against ground electrode 82 of planar capacitor 80, and is thereby in electrical contact with ground electrode 82.

Figure 9:
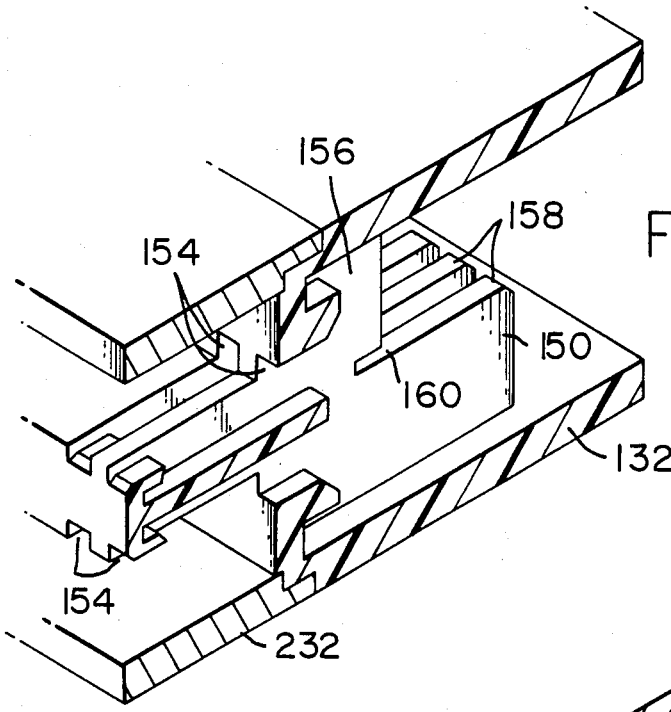
FIG. 9 shows a perspective of the connector in part longitudinal section along lines 9—9 of FIG. 7, with the planar capacitor and terminals removed.
Figure 10:
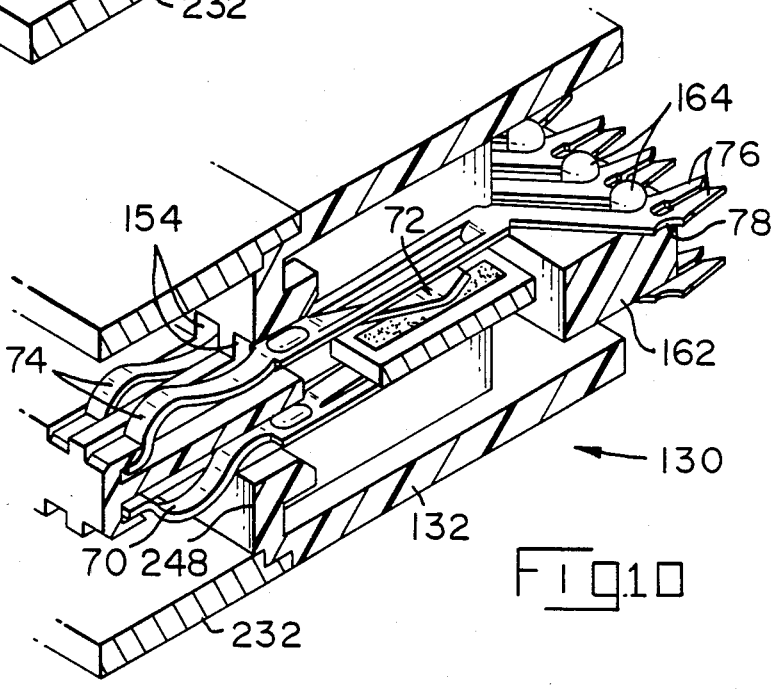
FIG. 10 shows FIG. 9 with terminals, planar capacitor and support member in place.

FIGS. 9 and 10 illustrate the inner features of connector 130. FIG. 8 is a longitudinal section 232 shell member 232 and main dielectric housing 132 with terminals 70 removed. Between terminal cavities 154 and longitudinally extending ribs 156 directed inwardly from sides of dielectric housing member 132 and having centrally facing edges 158 which altogether form a capacitor-holding slot 160. Planar capacitor 80 is positionable between centrally facing edges 158 such that edges 158 of ribs 156 engage planar capacitor 80 between live electrodes 84 on side surfaces of planar capacitor 80.

FIG. 10 shows terminals 70 in position in connector 130. Terminals 70 are secured in terminal cavities 154, have curved contact sections 74 proximate forward end 248 of shell member 232, and have slotted contact sections 76 extending outward from rearward end 150 of dielectric housing 132 to engage conductors 85 of cable 88 (see FIG. 7) by insulation displacement. Intermediate the contact sections 74 and 76 of each terminal 70 is a spring contact section 72 extending toward and in engagement with a live electrode 84 of planar capacitor 80. Once terminals 70 and planar capacitor 80 are in place within shell member 232 and main housing 132 a dielectric support member 162 is adheringly secured against rearward end 150 of main dielectric housing 132, behind and against planar capacitor 80 and between and against the two rows of terminals 70. Dielectric support member 162 has spaced projections 164 which extend between terminals 70, and engage terminals 70 in notches 78 thereof to space said terminals and secure them against lateral and longitudinal movement.

With reference to FIG. 7, a dielectric securing body portion 66 is then secured to rearward end 150 of dielectric housing 132 to secure planar capacitor 80 and terminals 70 within connector 130. When conductors 86 of cable 88 are then terminated to slotted contact sections 76 of associated terminals 70, a dielectric cover member 68 is latchingly secured to the outer end of securing body portion 66. Cover member 68 is used to push conductors 86 into the slots of slotted contact sections 76. Grounding clip 10 may then be placed in position as shown in FIGS. 7 and 8, secured to shell 232 and dielectric housing 132 by spring contact arm 18 and fastening arm 16, to complete the connector assembly.

Connector assembly 130 (without reference to a Figure hereof) is mountable to the backplane of a piece of equipment by a mounting means such as a bolt, so that grounding clip 10 is adjacent to and in electrical engagement with a ground plane of the backplane. Also, other means of grounding the connector 130 are possible by connecting grounding clip 10 to ground, since grounding clip 10 is on the outside surface of connector 130.

Figure 11:
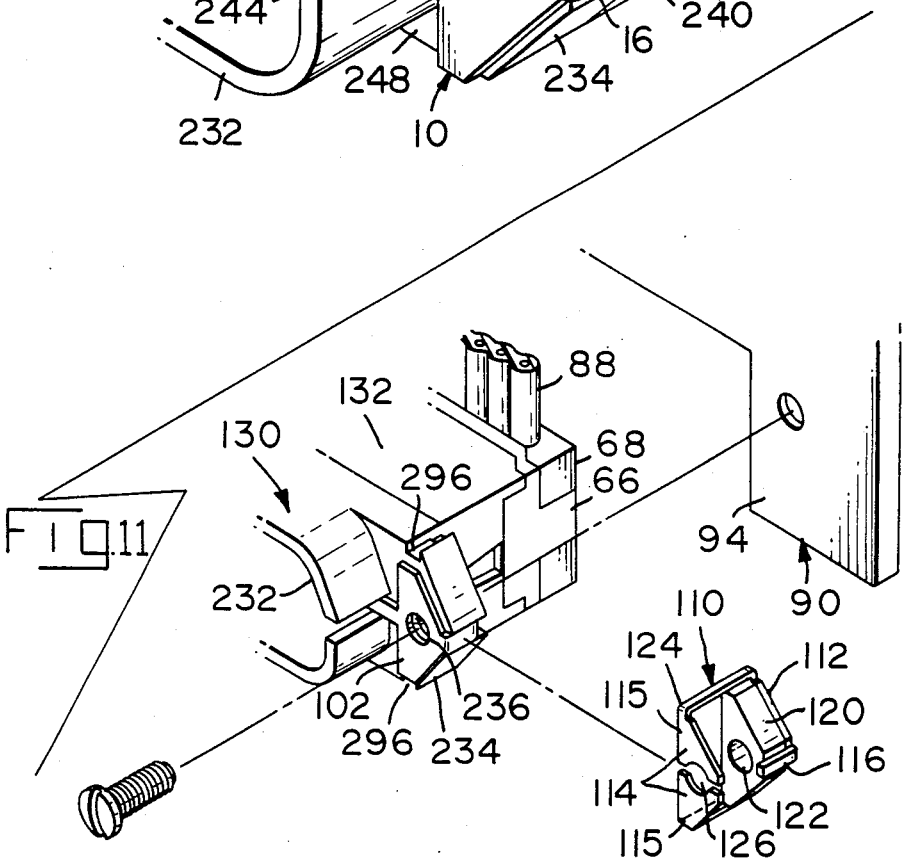
FIG. 11 shows a perspective view of a modified adaptor clip with a spacer, for use with the connector of FIG. 7.

Since mounting flanges 234 of connector 130 are metal, there is no need to use a metal adaptor 100 (shown in FIG. 5) for direct mounting of connector 130 to a panel or backplane of equipment. A modified metal adaptor clip 110, as shown in FIGS. 6 and 11 is required when a dielectric spacer is used. FIGS. 6 and 11 illustrate a modified metal adaptor clip 110 which is modified to incorporate a dielectric spacer 120, having a preselected thickness and an outline matching that of mounting flange 234 and a hole 122 therethrough. Adaptor clip 110 has opposing body portions 112, 114 and a pair of bridge arms 124 interconnecting body portions 112 and 114. Each body portion 112, 114 has a hole 126 therethrough such that holes 126 of each adaptor clip 110 are aligned with holes 236 of mounting flanges 234 when adaptor clips 110 are secured thereto. Each modified adaptor clip 110 preferably stamped and formed. When formed, one body portion 114 will be comprised of two halves 115 which will meet or nearly meet each other. Bridge arms 124 extend through associated side recesses 296 on the sides of mounting flange 234 and proximate housing 232 to secure adaptor clip 110 to the connector assembly 130. Modified adaptor clip 110 allows the connector assembly to be mounted onto a backplane 90 (with one body portion 112 of modified adaptor clip 110 in electrical engagement with a ground plane 94 on backplane 90, the other body portion 114 with grounding clip 10 in a manner varying the depth to which connector assembly 130 extends into the backplane 90, and hence the distance which connector 130 extends outwardly from the backplane. Spacer 120 is held by fastening arm 116 and may be adhered to modified adaptor clip 110 within it, secured at the point of manufacture, in order to simplify the mounting procedure.

The use of the grounding clip of the present invention presents a more economical way for grounding a planar capacitor of a filtered connector by reducing the amount of metal used in each connector, and simplifying the assembly of such a connector. Use of the adaptor clip (and/or spacer) enables mounting of either forward-facing or rearward-facing flange surfaces of the connector to a backplane and varying the depth to which the connector extends into the backplane, thus providing more options in mounting a connector.

What is claimed is:

1. An electrical connector assembly including a dielectric housing, a plurality of terminals contained within said housing and terminated to respective electrical conductors, said terminals having contact portions to electrically engage mating terminals, a planar filter means contained within said housing having live electrodes on side surfaces and ground electrodes on end surfaces thereof, said live electrodes electrically engaging said terminals, said housing having at least one mounting flange for mounting said connector to a panel, and at least one grounding means, said connector assembly being characterized in that:

said housing has a cavity proximate said at least one mounting flange in communication with a side of said housing adjacent said mounting flange and extending into said housing in communication with a said ground electrode of said planar filter means;

said at least one grounding means has a body portion and a spring contact arm extending substantially normally from said body portion;

said grounding means is securable to said mounting flange such that said spring contact arm is inserted into said cavity of said housing from outside thereof after assembling said terminals and said planar filter means within said housing, said spring contact arm electrically engaging said ground electrode of said planar filter means and such that said body portion is disposed on a surface of said mounting flange, said body portion being electrically engagable with a ground plane of a panel to which said connector is to be mounted, whereby when said connector assembly is mounted to said panel an electrical ground is formed between said ground electrode of said planar filter means and said ground plane.

2. An electrical connector assembly as set forth in claim 1 further characterized in that said assembly further includes an adaptor clip means securable to said grounding body portion and said mounting flange, said adaptor clip having opposing body portions connected to each other by at least one bridge arm, one of said adaptor body portions engageable with said body portion of said grounding means, and the other of said adaptor body portions disposable on a surface of said mounting flange opposed from said surface on which is disposed said body portion of said grounding means, whereby when said adaptor clip means is secured to said grounding body portion and said mounting flange said connector is mountable to a panel such that said other of said adaptor body portions engages a ground plane of said panel and an electrical ground is formed between said ground electrode of said planar capacitor and said ground plane.

3. An electrical connector assembly as set forth in claim 2 further characterized in that said assembly further includes a spacer means disposed between said other of said body portions of said adaptor clip means and said opposing surface of said mounting flange.

4. An electrical connector assembly as set forth in claim 2 further characterized in that said mounting flange, said body portion of said grounding means, and said body portions of said adaptor clip means have aligned mounting holes therethrough such that mounting means is extendable therethrough to mount said assembly to said panel.

5. An electrical connector assembly as set forth in claim 1 further characterized in that said spring contact arm of said grounding means has a stop surface and said cavity has a cooperating stop surface which cooperates with said spring contact arm stop surface to secure said grounding means to said housing.

6. An electrical connector assembly as set forth in claim 1 further characterized in that said grounding means further includes a fastening arm extending from said body portion and adjacent a side surface of said mounting flange, said fastening arm having a stop surface, and said mounting flange has a cooperating stop surface which cooperates with said fastening arm stop surface to secure said grounding means to said housing.

7. An electrical connector assembly as set forth in claim 1 further characterized in that said housing has two mounting flanges and two said cavities, and said assembly includes two said grounding means.

8. An electrical connector assembly as set forth in claim 1 further characterized in that said mounting flange and said body portion of said grounding means have aligned mounting holes therethrough such that mounting means is extendable therethrough to mount said assembly to said panel.

9. An adaptor clip securable to a mounting flange of a filtered electrical connector comprised of a housing means having a plurality of electrical terminals and planar filter means therein, and said mounting flange having secured to one surface thereof a grounding clip in electrical engagement with a ground electrode of said planar filter means, said adaptor clip comprising a first body portion, two opposing bridge arms extending normally from and laterally thereof, and second body sections extending inwardly from ends of respective said bridge arms forming a split second body portion spaced from and opposed to said first body portion, said second body sections being springably urgeable apart enabling securing of said adaptor clip to said mounting flange such that one of said first and second body portions engages said grounding clip and the other of said first and second body portions is disposed on a surface of said mounting flange opposed from said one surface to engage a ground plane of said panel, whereby an electrical ground is formed between said ground electrode of said planar filter means and said ground plane.

10. An adaptor clip as set forth in claim 9 further including a dielectric spacer securable thereto between said other of said body portions and said opposing surface of said mounting flange.

11. An adaptor clip as set forth in claim 10 further including a fastening arm extending from said other of said body portions along a side of said spacer to assist in securing said spacer to said adaptor clip.

12. An electrical connector assembly including a dielectric housing, a plurality of terminals contained within said housing and terminated to respective electrical conductors, said terminals having contact portions to electrically engage mating terminals, a planar filter means contained within said housing having live electrodes on side surfaces and ground electrodes on end surfaces thereof, said live electrodes electrically engaging said terminals, said housing having at least one mounting flange for mounting said connector to a panel, and at least one grounding means, said connector assembly being characterized in that:

said housing has a cavity proximate said at least one mounting flange in communication with a side of said housing adjacent said mounting flange and extending into said housing in communication with a said ground electrode of said planar filter means;

said at least one grounding means including a grounding clip member and an adaptor clip member, said grounding clip member has a body portion and a spring contact arm extending substantially normally from said body portion and said adaptor clip member has a first adaptor body portion, two opposing bridge arms extending normally from and laterally thereof, and second body sections extending inwardly from ends of respective said bridge arms forming a split second adaptor body portion spaced from and opposed to said first adaptor body portion, said second adaptor body sections being springably urgeable apart enabling securing of said adaptor clip member to said mounting flange;

said grounding clip member is securable to said mounting flange such that said spring contact arm is inserted into said cavity of said housing from the outside thereof to electrically engage said ground electrode of said planar filter means and said grounding clip body portion is disposed on a surface of said mounting flange;

said adaptor clip member is securable to said mounting flange such that one of said first and second adaptor body portions engage said ground clip and the other of said first and second adaptor body portions is disposed on a surface of said mounting flange opposed from said one surface to engage a ground plane of said panel, whereby an electrical ground is formed between said ground electrodes of said planar filter means and said ground plane.

13. An electrical connector assembly as set forth in claim 12 further including dielectric spacer securable thereto between said other of first and second adaptor body portions and said opposing surface of said mounting flange.

14. An electrical connector assembly as set forth in claim 13 further including a fastening arm extending from said other of said first and second adaptor body portions along a side of said spacer to assist in securing said spacer to said adaptor clip member.

15. An electrical connector assembly comprised of a two part housing means, said housing means having a metal shell member and a main dielectric housing member, a plurality of terminals contained within said housing means and terminated to respective electrical conductors, said terminals having contact portions to electrically engage mating terminals, a planar filter means contained within said housing means having live electrodes on side surfaces and ground electrodes on end surfaces thereof, said live electrodes electrically engaging said terminals, said housing means having at least one mounting flange for mounting said connector to a panel, and at least one grounding means, said connector assembly being characterized in that:

said housing means has a cavity proximate said at least one mounting flange in communication with a side of said housing means adjacent said mounting flange and extending into said housing means in communication with a said ground electrode of said planar filter means;

said at least one grounding means has a body portion and a spring contact arm extending from said body portion;

said grounding means is securable to said mounting flange such that said spring contact arm is inserted into said cavity of said housing from outside thereof after assembling said terminals and said filters means within said housing means, said spring contact arm electrically engaging said ground electrode of said planar filter means and such that said body portion is disposed on a surface of said mounting flange, said body portion being electrically engagable with a ground plane of a panel to which said connector is to be mounted, whereby when said connector assembly is mounted to said panel an electrical ground is formed between said ground electrode of said planar filter means and said ground plane.

16. An electrical connector assembly as set forth in claim 15 further characterized in that said spring contact arm of said grounding means has a stop surface and said cavity has a cooperating stop surface which cooperates with said spring contact arm stop surface to secure said grounding means to said housing means.

17. An electrical connector assembly as set forth in claim 15 further characterized in that said grounding means further includes a fastening arm extending from said body portion and adjacent a side surface of said mounting flange, said fastening arm having a stop surface, and said mounting flange has a cooperating stop surface which cooperates with said fastening arm stop surface to secure said grounding means to said housing means.

18. An electrical connector assembly as set forth in claim 15 further characterized in that said housing means has two mounting flanges and two said cavities, and said assembly includes two said grounding means.

19. An electrical connector assembly as set forth in claim 15 further characterized in that:

said assembly further includes an adaptor clip means and spacer means securable to said mounting flange, said adaptor clip having opposing body portions connected to each other by at least one bridge arm, one of said body portions engageable with said body portion of said grounding means, and the other of said body portions disposable on a surface of said mounting flange opposed from said surface on which is disposed said body portion of said grounding means, and said spacer means is disposed between said other of said body portions of said adaptor clip means and said opposing surface of said mounting flange whereby when said adaptor clip means and said spacer means are secured to said mounting flange said connector is mountable to a panel such that said other of said body portions of said adaptor clip means engages a ground plane of said panel and an electrical ground is formed between said ground electrode of said planar capacitor and said ground plane.

20. A grounding clip means securable to a preassembled filtered electrical connector mountable to a panel, to ground a planar filter means therein to the panel, said grounding clip means comprising a body portion and a spring contact arm portion one end of which extends substantially normally from the plane of said body portion, said spring contact arm portion having a bent-back portion forming a stop surface at its other end, said grounding clip means being securable to said connector by said spring contact arm portion being inserted into an axially extending cavity of the preassembled connector from outside thereof to electrically engage a ground electrode of the planar filter means and said body portion being external to said connector whereby when said connector is mounted to a panel said body portion engages a ground plane on said panel thereby grounding said planar filter means.

21. A grounding clip as set forth in claim 20 wherein said spring contact arm has a stop surface to engage a cooperating stop surface in said cavity of said connector to secure said grounding clip to said connector.

22. A grounding clip as set forth in claim 20 further including a fastening arm extending from said body portion, said fastening arm having a stop surface to engage a cooperating stop surface on said connector to secure said grounding clip to said connector.

* * * * *